United States Patent [19]

Ravensbergen

[11] Patent Number: 4,922,566

[45] Date of Patent: May 8, 1990

[54] METHOD FOR OPTIMIZING FLOW AND TEMPERATURE IN WASH WATER WHEN WASHING OUT FABRIC WEBS

[76] Inventor: Daniel W. Ravensbergen, Bosdreef 34, NL-2352 BC Leiderdorp, Netherlands

[21] Appl. No.: 286,745

[22] Filed: Dec. 19, 1988

[30] Foreign Application Priority Data

Dec. 18, 1987 [NL] Netherlands ..... 8703074

[51] Int. Cl.[5] ..... D06B 3/12; D06B 23/00

[52] U.S. Cl. ..... 8/151; 8/158; 68/13 R; 68/27

[58] Field of Search ..... 8/151, 158; 68/13 R, 68/27

[56] References Cited

FOREIGN PATENT DOCUMENTS 0087391 8/1983 European Pat. Off. .
0197429 10/1986 European Pat. Off. .
2443524 7/1980 France .

*Primary Examiner*—Philip R. Coe
*Attorney, Agent, or Firm*—Hill, Van Santen, Steadman & Simpson

[57] ABSTRACT

A method for adjusting the flow and the temperature of wash water when washing out contaminations from fabric webs in textile processing methods upon employing of an open-width washing machine, whereby replacement factors are calculated at different temperatures and the costs of the wash water flow and steam consumption are consequently calculated and the corresponding wash water flow and the corresponding steam delivery are set for minimizing these costs.

3 Claims, 5 Drawing Sheets

METHOD FOR OPTIMIZING FLOW AND TEMPERATURE IN WASH WATER WHEN WASHING OUT FABRIC WEBS

BACKGROUND OF THE INVENTION

1. Field of the Invention

The invention is directed to a method for adjusting the flow and the temperature of wash water when washing out contaminates, such as excess chemicals, from fabric webs in textile processing. In particular, an open-width washing machine is used in which a fabric web is conducted through a plurality of wash tubs connected in series and the warm wash water is conducted through these wash tubs in counter-current flow, whereby the flow and the temperature of the wash water are set.

2. Description of the Related Art

During washing of fabric webs in textile processing, the extent of the wash-out or of what is referred to as the washing action can be monitored with contaminate concentration sensors. For example, such a contaminate concentration sensor is a pH meter or a conductivity sensor that measures the extent of the conductivity of the fabric contaminated with excess chemicals. Such a sensor can be pressed against the fabric upon input into the machine and upon output from the machine. The water flow and the water temperature can thereby be set for a defined value of the desired washing action given a fabric of a defined quality. This, however, is only valid for a single fabric quality, and a different setting of the water flow and of the temperature must be applied given a different fabric quality in order to achieve the corresponding washing action.

In general, the water flow and water temperature is set at an excess of water and at a higher than needed temperature that are so broadly dimensioned that the desired washing action is achieved for all fabric qualities. Considerable energy is required for this washing process given the excess flow rate setting and high temperature setting to bring the rinse water, or wash water, and the fabric to be washed up to temperature, to maintain the required temperatures, i.e. to compensate energy losses that occur, and to drive the machines.

Practice has shown that the thermic yield of the washing process is frequently not optimum. The desired washing action, namely, can be achieved in various ways, whereby the following are valid at the extremes: (a) a great quantity of water and low temperature or (b) little water and a high temperature. In general, the known process is carried out with too much wash water and too high a temperature, this leading to high energy costs. Particularly given increasing (excessively high) temperature, the energy losses (and, consequently, the energy costs) rise exponentially, among other things because the evaporation of the water is far greater at high temperature.

SUMMARY OF THE INVENTION

The present invention eliminates the afore-mentioned problems and provides an improved method with which an optimally cost-beneficial adjustment of flow and temperature of the wash water is achieved in a fast way while obtaining the desired washing effect. This method is employable for all fabric qualities. When the method of the invention is applied using an open width washing machine, the advantages are achieved in such fashion that the wash water flow and the washing action are measured with a measurement at a water temperature and a corresponding, first replacement factor is calculated therefrom; in that the wash water flow and the washing action are measured again with a further measurement at a further temperature and another, corresponding, second replacement factor is calculated therefrom, the linear relationship $M=f(T)$ being calculated from said first replacement factor, said second replacement factor and corresponding temperatures; and that the corresponding, required replacement factors and - via the said linear relationship - the required temperatures are calculated for continuously incrementing values of wash water flow and desired washing action in the flow range, whereby the costs of the consumption of wash water flow and steam are respectively calculated and the corresponding wash water flow and the corresponding steam delivery are set on the basis of the minimum value of these costs deriving therefrom.

In such an embodiment of the invention, it is possible to adapt an open-width washing machine in such fashion than economical system is obtained while obtaining the desired washing action. As a result thereof, the average energy consumption can thereby be reduced by 40 to 50 percent in comparison to the known method.

DESCRIPTION OF THE PREFERRED EMBODIMENTS

Figure 1:
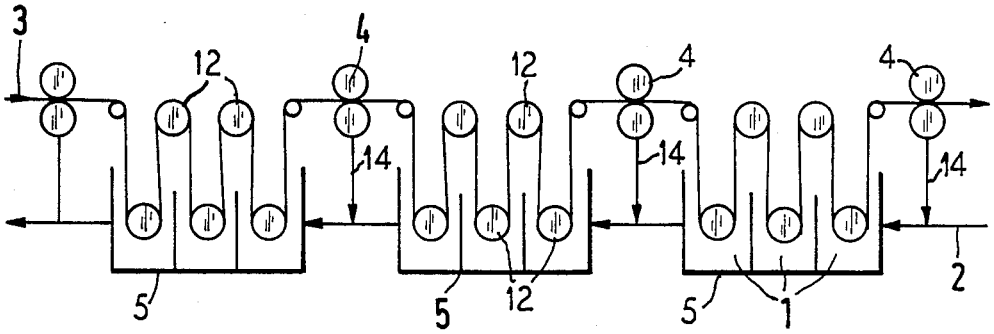
FIG. 1 is a schematic illustration of an open-width machine having three wash tubs divided into washing compartments.
Figure 2:
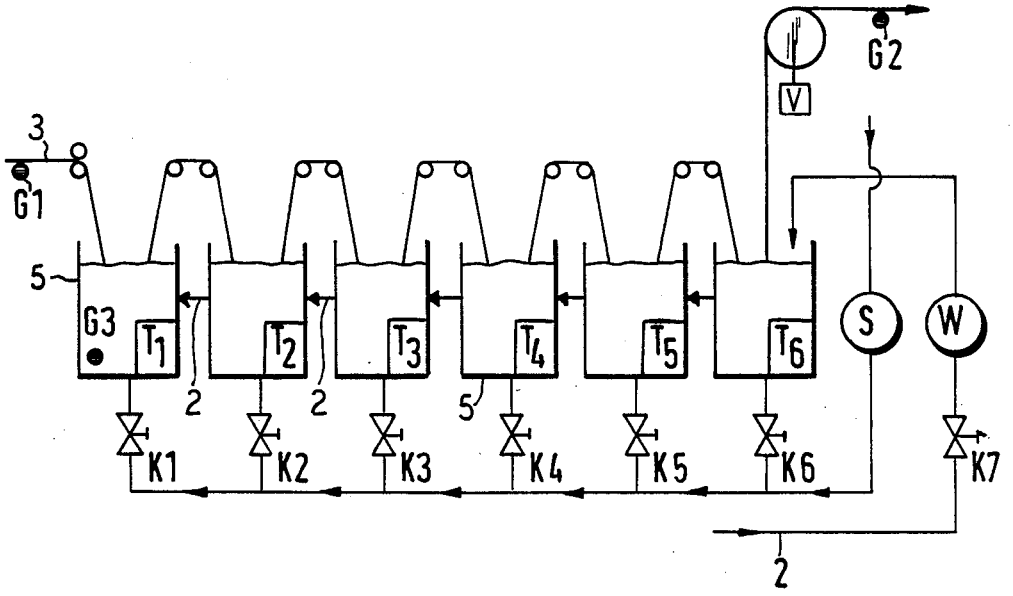
FIG. 2 is a schematic diagram of a washing apparatus showing the principle of the measuring and control elements that are employed in the method of the invention.

FIG. 1 schematically shows an open-width washing machine in which excess chemicals such as alkali and reaction products derived from steeping and bleaching treatments are rinsed out of a fabric web 3. For example, such a machine has three wash tubs 5, whereby every wash tub 5 is divided into three series-connected washing compartments 1 in order to increase the washing action. Wash water 2 is conducted through the machine in a counter-current flow method, whereby the fresh rinse water 2 flows into the machine at the right-hand side and subsequently flows through all compartments. The textile or fabric web 3 to be washed enters into the machine at the left-hand side and is conducted through all compartments on rollers 12. The fabric running can thereby be both vertical as well as horizontal. The fabric 3 is pressed by a pressing or wringing unit 4 after every wash tub 5 and the water that is wrung out returns into the flowing wash water 2 through a conduit 14. The wash water 2 is brought to temperature and held at temperature per wash tub, for example, by blowing hot steam in, shown for example in FIG. 2. At the same time, a contaminate concentration sensor, such as one of conductivity sensors G1, G2 and G3, that is pressed against the fabric has been attached at the admission and, potentially, at one of the wash tubs, and at the discharge, also as shown in FIG. 2.

In practice, wash water consumption and temperature (i.e., steam delivery) are generally heretofore selected such that a good rinsing or washing effect is obtained under all conditions. This almost always means too much wash water and excessively high temperatures, which in turn leads to high energy costs.

The invention now provides a method for the optimum adaptation of wash water flow and temperature so that an energy savings is realized while obtaining the desired washing action. The method is practiced by the apparatus as shown in FIG. 2. Flowmeters W and S are arranged in both main delivery lines for measuring the wash water consumption and steam consumption, respectively, and temperature sensor T1 through T6 such as, for example, a Pt-100 element have been installed in the individual wash tubs for the temperature measurements. A velocity meter V for the speed of the fabric web 3 has likewise been provided. The valves K1 through K6 in the steam delivery lines are preferably flow-controlled, pneumatic valves, as is the wash water valve K7. The conductivity sensors G1 through G3 have been attached at the admission of the fabric web 3, in of the wash tubs 5 and at the discharge of the fabric web 5 in order to measure the contamination of the fabric.

Figure 3:
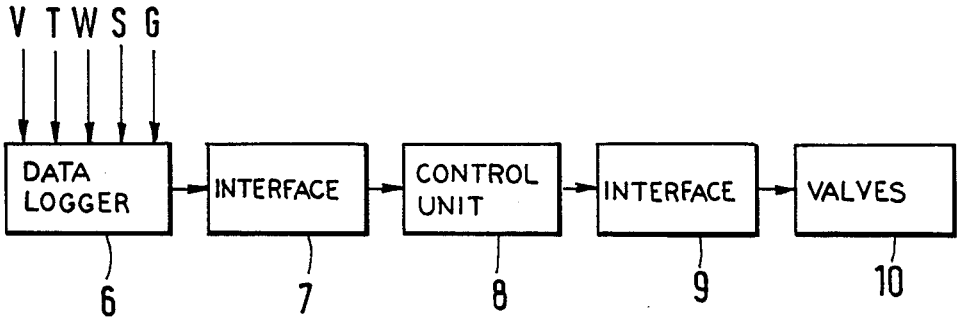
FIG. 3 is a functional block diagram of a control unit employed to practice the invention.

A control unit 8 as provided in FIG. 3 can be a microcomputer. The measured data of the temperature sensors T, of the conductivity sensors G and of the meters W, S, V are collected by a data logger 6 that forwards them via an interface 7 to the control unit 8 once every ten seconds. The control signals in binary code deriving from the control unit 8 are converted via an interface 9 into control signals of 4 through 20 mA for the valves K1–K7 referenced 10 in general. A proportional control is thereby applied for the water flow and a PID control is applied for the temperature.

The control ensues on the basis of measuring the concentration of the contamination in the fabric, for example on the basis of the conductivity that proportionally corresponds to this concentration of the contaminate. The value of the desired conductivity after n compartments or wash tubs 5, together with the conductivity measured at the admission, yields the desired washing action $\phi$ this is the conductivity $C_n$ of the fabric at the discharge divided by the conductivity $C_o$ at the admission: $\phi = C_n/C_o$. The optimally cost-beneficial combination of water flow and temperature is calculated for this desired washing action, whereupon this is set via the valves K1–K7 and is reset in case of deviations.

It is assumed in general that every washing compartment 5 has the same washing action given an identical water flow and given the same temperature. Since this is not always the case in practice, for example, as a consequence of the dimensions of the compartments and of the pressing or wringing of the wash water from the fabric between specific compartments, one works with the average washing action per compartment.

Figure 4:
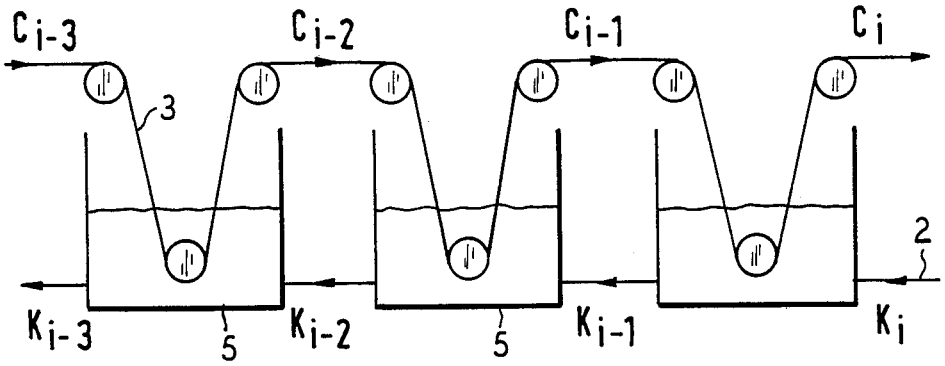
FIG. 4 is a schematic diagram of a washing apparatus for explaining the calculation of the replacement factor to be applied to a washing compartment.

FIG. 4 shows a schematic illustration of an open-width washing machine comprising a plurality of i compartments or tubs 5 into which the fabric 3 is introduced at the left and is discharged at the right and the contamination of this fabric decreases from left to right. The contamination in the wash water flow 2 thereby increases from right to left. $C_o \ldots C_{i-3}$, $C_{i-2}$, $C_{i-1}$, Ci is the contaminate concentration of the fabric between each compartment 5 as well as before the first and after the last compartment. $K_o \ldots K_{i-3}$, $K_{i-2}$, $K_{i-1}$, Ki is the concentration of the contamination in the wash water 2. A replacement factor M for a washing compartment is thereby defined as the fraction of the liquid or contaminant entering together with the fabric that is replaced by wash water. In other words, the replacement factor is the change in the contaminant concentration of the fabric as it passes through the respective compartment over the amount of the contaminant transferred from the fabric to the wash water in that compartment.

$$M = (C_{i-1} - C_i)/(C_{i-1} - K_{i-1}) \quad (1)$$

Given complete replacement, M=1 applies, and M=0 applies given no replacement. The replacement factor M proves to be linearly dependent on temperature in the working range:

$$M = RC \cdot T + B(T \text{ in } ^\circ C.) \quad (2).$$

wherein RC and B are constants that are defined by the type of wash compartment and by the fabric quality. M is likewise independent of the size of the water flow. According to a simple wash model, a function for the relationship between that fraction $\phi = C_n/C_o$ that is not washed out can be derived from the replacement factor M and from the liquid flow rate. This relationship can be written in the following way:

$$C_n/CO = (1-F)/(1-F(F/P)^n) \quad (3),$$

wherein F is the phase relationship or the volume of the wash water supplied per second divided by the volume of the wash water entrained with the fabric per second, and wherein P=F−MF+M. A fixed, average value is thereby assumed for the volume of the water entrained with the fabric per second.

Figure 5:
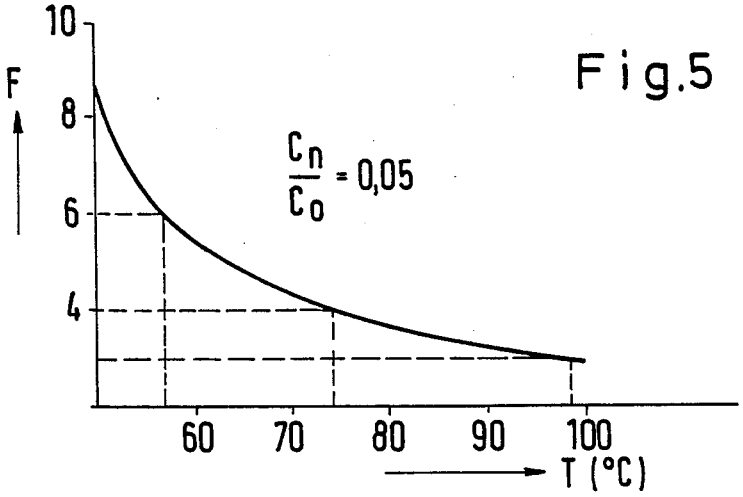
FIG. 5 is a graph showing an example of the relationship between the phase relationship and the temperature at a defined washing action.

On the basis of the afore-mentioned equations (2) and (3), their relationship between the washing action $\phi = C_n/C_O$, the wash water temperature T and the phase relationship F can be calculated, as recited by way of example for a defined washing action as shown in FIG. 5. It proceeds from FIG. 5 that a defined, desired washing action can be achieved with a great plurality of adjustments of water flow and temperatures. In order to calculate the optimally cost-beneficial combination, the costs of steam and water at these settings must be known.

The quantity of steam required for heating the wash water and the fabric covers the theoretically required quantity of steam in order to bring the wash water and the fabric to temperature (linearly dependent on the temperature) and the required quantity of steam for compensating the thermal losses.

Figure 6:
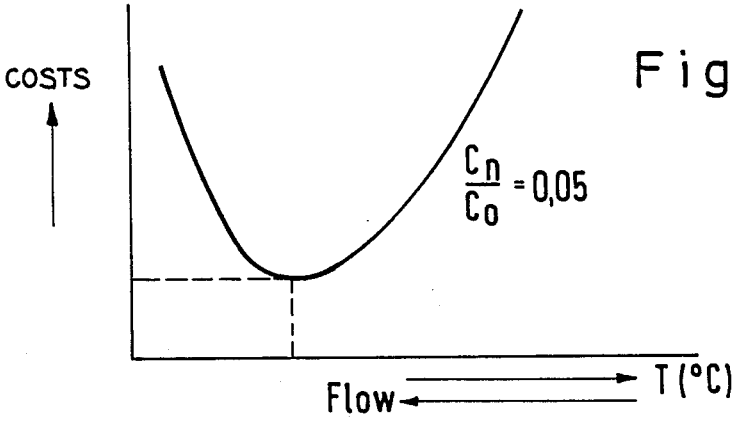
FIG. 6 is a graph showing an example of the relationship between the operating costs and a combination of wash water flow and temperature given a defined washing action.

When the overall costs for water and steam are set off compared to the individual combinations of water flow and temperature that produce a defined, desired washing action, the relationship as shown in FIG. 6 derives. It proceeds from FIG. 6 that an optimally cost-beneficial combination of water flow and temperature can be found for every desired washing action.

On the basis of the earlier data, the following control model or method is provided which is practiced by the control unit:

(1) inputing the measured values into the control unit;
(2) calculating the means value of the measured values;
(3) calculating the replacement factor M from the measured washing action $\phi = C_n/C_O$ and from the water flow rate;
(4) calculating the relationship between the replacement factor M and temperature T;
(5) identifying the optimally cost-beneficial combination of water flow and temperature given a desired washing action;
(6) setting the points of adjustment for the valves.

When the equation (3) already mentioned above is rewritten, the following equation is obtained for the average replacement factor M:

$$M = \frac{F}{F-1}\left\{1 - \frac{PF}{F+\phi-1}\right\}^{1/n}, \quad (4)$$

wherein n = the plurality of compartments (for example, 12). From the equation (4) already recited above, a value of M that belongs to a desired washing action and to a selected value of water flow follows for a washing machine having a plurality of n compartments. In order to be able to calculate at what water temperature the desired value M (for a desired washing action) is achieved given a specific open-width washing machine, the relationship between these two quantities must be known. Given the assumption that this relationship is linear, the directional coefficient (RC) and the axis crossing (B) of the straight line M = f(T) must first be calculated.

Figure 7:
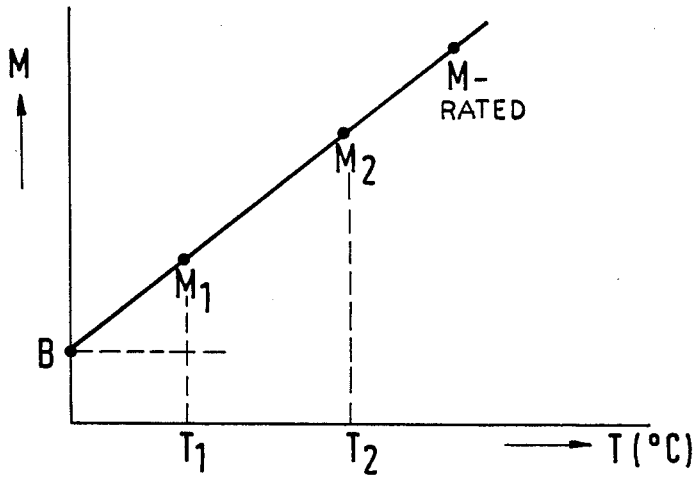
FIG. 7 is a graph showing an example of the relationship between replacement factor and temperature.

With reference to FIG. 7, this relationship is calculated in the following way:

in a first measurement pass, the corresponding M-value is calculated at a defined temperature from the average measured values of the conductivity at the admission and at the discharge and from the water flow, this yielding a first estimate of the directional coefficient RC of the function M = f(T).

In a second measurement pass, a second, corresponding M-value is calculated at a following temperature from the measured values of the conductivity and from the flow. A new directional coefficient RC is calculated from this second corresponding M-value and the next most recently calculated M-value. The last two M-values are always used in this way in order to define the straight line M = f(T).

Figure 8:
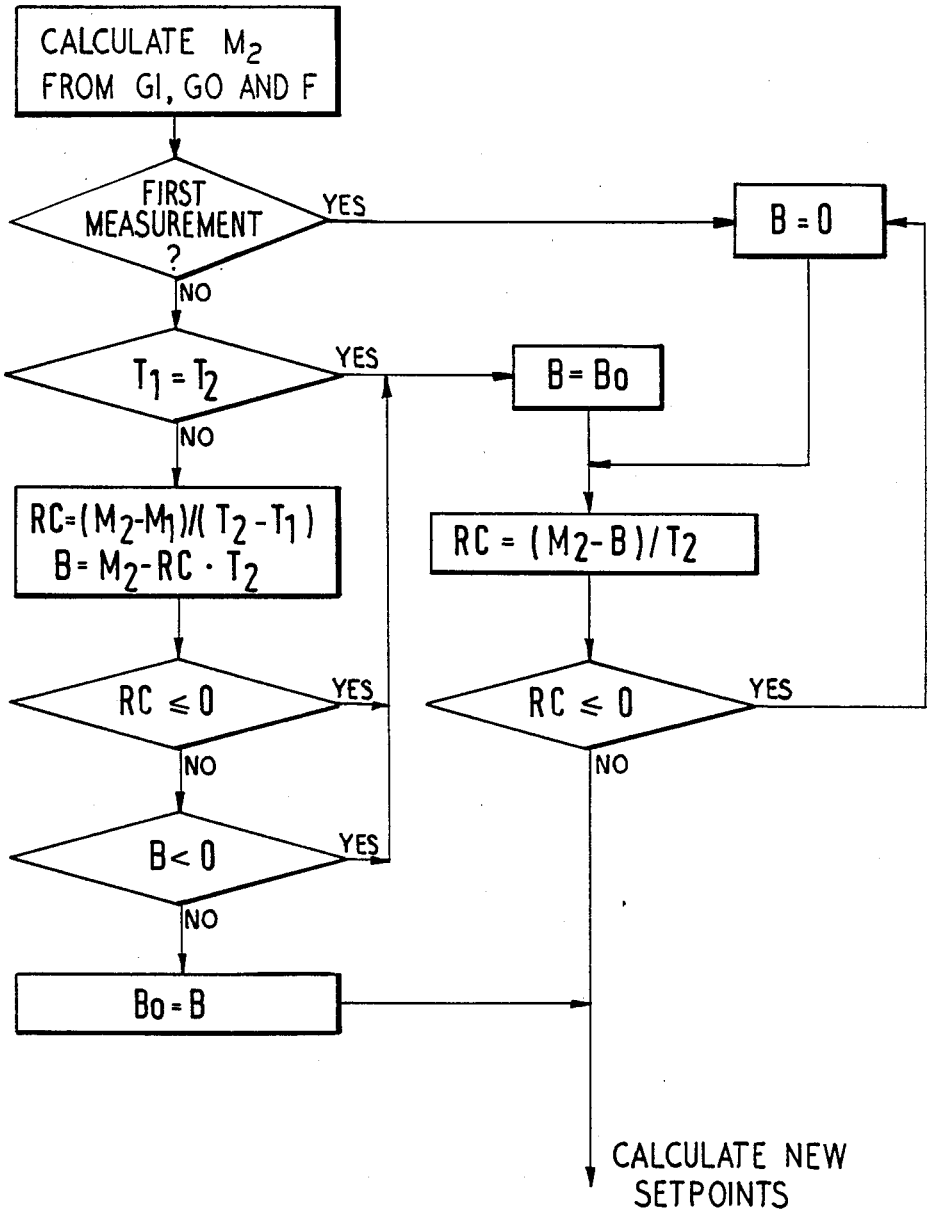
FIG. 8 is a flow chart for defining the relationship between the replacement factor and the temperature.

The following situations can derive in these calculations, as is likewise recited in the flow chart of FIG. 8:

(1) a value of zero is assumed in a first measurement for the axis crossing.
(2) When the measured temperatures $T_1$ and $T_2$ are different in a following measurement, the straight line is defined in the following way:

$$RC = (M_2 - M_1)/(T_2 - T_1) \text{ and } B = M_2 - RC \cdot T_2 \quad (5),(6)$$

(3) When the measured temperatures $T_1$ and $T_2$ are identical in a following measurement or when a negative RC or B arises due to any cause whatsoever, the straight line is defined in the following way:

$$RC = (M_2 - B_o)/T_2. \quad (7)$$

$B_o$ therein is the most recently measured value of B and a fixed, practical value is assumed for $B_o$ when this is too high.

Figure 9:
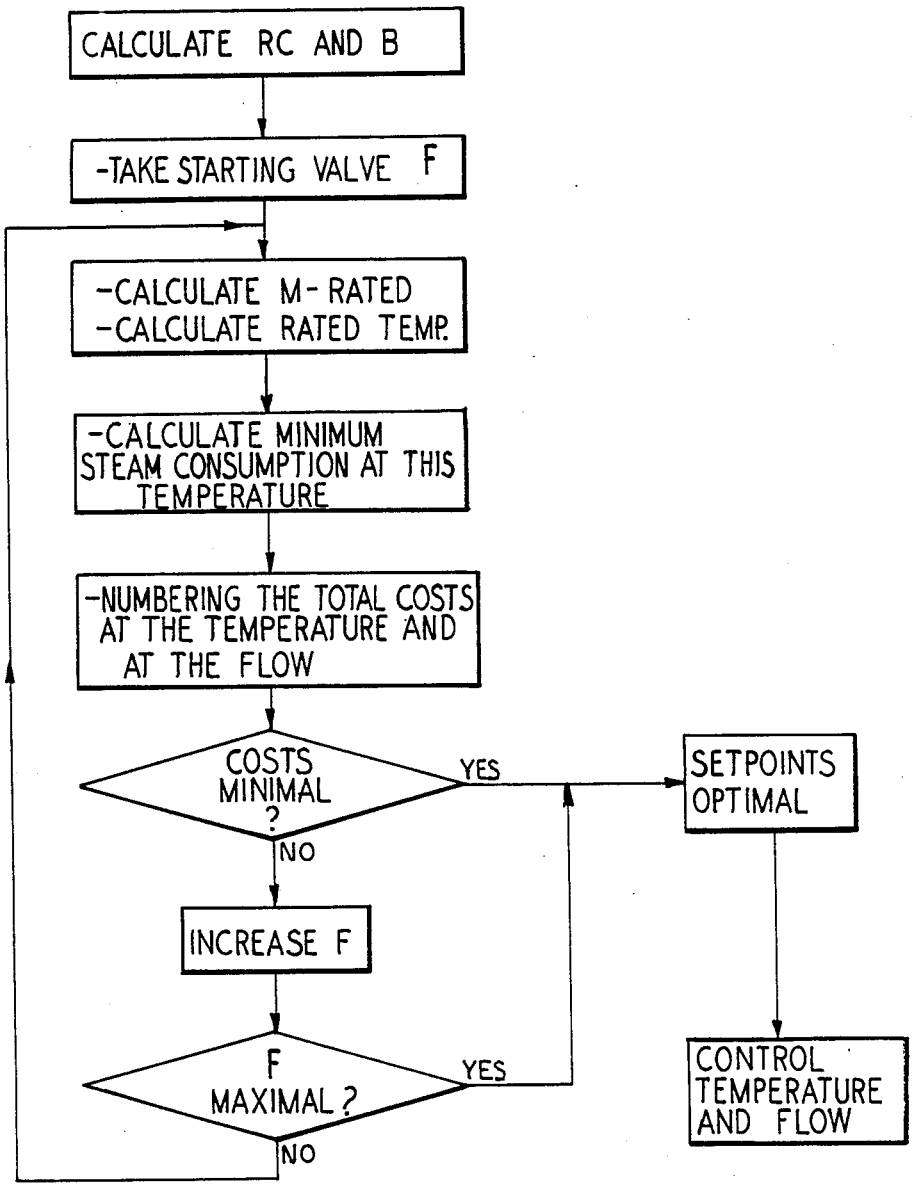
FIG. 9 is a flow chart of the cost-minimum adjustment of wash water flow and temperature.

After the afore-mentioned relationship between M and T has been calculated, the corresponding, desired replacement factor M and the corresponding temperature T can be calculated proceeding from an initial value and, following thereupon, from incrementing values of the water flow in the flow range. The corresponding costs are calculated for these subsequent combinations of water flow and temperature and that combination having the minimum costs is selected therefrom. This combination of water flow and temperature is then set, all as recited in the flow chart of FIG. 9.

The attached table 1 recites the results obtained for a series of fabric webs with the earlier method and with the new method. It is clear that a considerable energy savings is achieved while retaining the required washing action.

Although other modifications and changes may be suggested by those skilled in the art, it is the intention of the inventor to embody within the patent warranted hereon all changes and modifications as reasonably and properly come within the scope of his contribution to the art.

TABLE I

| | | Average Results of Five Tests carried out in practice | | | | | | |
|---|---|---|---|---|---|---|---|---|
| | | Normal Self-Control | | Tests With the Control System | | | | |
| | | | | No. 1 | No. 2 | No. 3 | No. 4 | No. 5 |
| Type of Fabric | | Cotton | Cotton | Cotton | Cotton | Cotton | Cotton | Cotton |
| Fabric Weight in g/m² | | 225 | 250 | 260 | 263 | 340 | 195 | 135 |
| Weave | | Flat | Twill | Twill | Satin | Satin | Flat | Flat |
| Temp | Tub No. 1 | 95 | 95 | 60 | 59 | 85 | 45 | 45 |
| erature | Tub No. 2 | 94 | 95 | 60 | 59 | 85 | 45 | 45 |
| in °C. | Tub No. 3 | 80 | 80 | 60 | 59 | 85 | 45 | 45 |
| | Tub No. 4 | 70 | 70 | 60 | 59 | 70 | 45 | 45 |
| | Tub No. 5 | 60 | 60 | 60 | 59 | 70 | 45 | 45 |
| | Tub No. 6 | 50 | 50 | 50 | 50 | 50 | 45 | 45 |
| Conductivity | Admission | 420 | 412 | 437 | 2.018 | 996 | 346 | 614 |
| of the | After Tub | | | | | | | |
| Fabric | No. 3 | 58 | 60 | 75 | 77 | 110 | 55 | 41 |
| (in μS) | After Tub | | | | | | | |

TABLE I-continued

| Average Results of Five Tests carried out in practice | | | | | | | |
|---|---|---|---|---|---|---|---|
| | Normal Self-Control | | Tests With the Control System | | | | |
| | | | No. 1 | No. 2 | No. 3 | No. 4 | No. 5 |
| No. 6 | 20 | 21 | 22 | 20 | 24 | 18 | 19 |
| Wash Water Flow in $m^3/h$) | 6.0 | 6.0 | 5.8 | 5.3 | 8.0 | 4.0 | 4.0 |
| Steam consumption (in kg/h) | 1,360 | 1,360 | 864 | 740 | 1,650 | 235 | 220 |
| Costs (NFl/h) | 88 | 88 | 60 | 52 | 107 | 21 | 20 |
| Control Time (h:min) | 0:57 | 1:00 | 0:48 | 1:53 | 1:19 | 1:46 | 1:48 |

I claim:

1. A method for adjusting a flow and temperature of wash water when washing out contaminates from fabric webs in a textile process using an open-width washing machine, wherein a fabric web is conducted through a plurality of series connected wash tubs and warm wash water is conducted through the wash tubs in a direction opposite a direction of movement of the fabric web, comprising the steps of:

measuring at a first water temperature a first wash water flow rate and a first washing action of water in the wash tubs as the fabric web is conducted through the was tubs, said first washing action being a ratio of concentration of contamination on the fabric web after washing and before washing;

calculating a first replacement factor from said measured first flow rate and said first washing action by means of the following equation:

$$M = \frac{F}{F-1}\left[1 - \frac{\phi F}{F+\phi-1}\right]^{1/n}$$

where M is the replacement factor, F is the volume of wash water supplied per second divided by the volume of water entrained by the fabric per second, n is the number of washing compartments, and $\phi$ is the ratio of concentration of contamination on the fabric web after washing and before washing and equals the first washing action;

measuring a second wash water flow rate and a second washing action at a second water temperature, said second washing action being a ratio of concentration of contamination on the fabric web after washing and before washing;

calculating a second replacement factor from said second flow rate and said second washing action;

calculating from said first and second replacement factors and from said first and second water temperatures coefficients of a linear relationship between replacement factor and temperature in accordance with the following equation:

$$M = RC \cdot T + B (T \text{ in } ^\circ C.)$$

by means of the following two equations:

$$RC = \frac{M_2 - M_1}{T_2 - T_1},$$

$$B = M_2 - RC \cdot T_2,$$

wherein $M_1$ is said first replacement factor, $M_2$ is said second replacement factor, $T_1$ is said first water temperature, and $T_2$ is said second water temperature;

calculating replacement factors $M_r$ for continuously incrementing values of wash water flow rate starting from a desired washing action $\phi_\alpha$, namely:

$$\phi_d = \frac{\text{desired concentration of contamination on fabric after washing}}{\text{concentration of contamination on fabric before washing}},$$

by means of the following equation:

$$M_T = \frac{F}{F-1}\left[1 - \frac{\phi_d F}{F+\phi_d-1}\right]^{1/n},$$

including calculating corresponding temperatures $T_t$ via the relationship:

$$T_T = \frac{M_T - B}{RC};$$

calculating the sum of costs of washing water flow and wash water heating for incremental values of wash water flow rate and corresponding wash water temperatures to form a table of costs;

choosing a wash water flow rate and a corresponding wash water temperature with a minimum cost from the table of costs; and setting a wash water flow rate through the wash tubs and a wash water temperature of the wash water in the tubs by means of wash water heating to the chosen flow rate and water temperature in order to derive minimum costs thereof.

2. A method as claimed in claim 1, wherein said volume of water entrained by the fabric web per second is assumed to be a fixed means value.

3. A method as claimed in claim 1, wherein said wash water heating is by steam and the step of said setting of said wash water temperature is by setting delivery of said steam.

* * * * *